US005131208A

United States Patent [19]

Paul et al.

[11] Patent Number: 5,131,208

[45] Date of Patent: Jul. 21, 1992

[54] METHOD AND APPARATUS FOR FORMING CARTONS

[75] Inventors: James A. Paul; John M. Overholt, both of Toledo; John R. Michael, Waterville, all of Ohio

[73] Assignee: Radco Industries, Inc., Toledo, Ohio

[21] Appl. No.: 648,856

[22] Filed: Jan. 31, 1991

[51] Int. Cl.[5] ..... B65B 11/20

[52] U.S. Cl. ..... 53/376.5; 53/207; 53/223; 53/564; 493/130; 493/141; 493/143

[58] Field of Search ..... 53/377.4, 383.1, 456, 53/458, 564, 574, 207, 376.5, 222, 223; 493/77-81, 128, 130-132, 138-141, 177, 142, 143

[56] References Cited

U.S. PATENT DOCUMENTS

| | | | |
|---|---|---|---|
| 3,046,849 | 7/1962 | Bowman | 493/143 |
| 3,771,282 | 11/1973 | Flanagan | 53/207 |
| 3,832,822 | 9/1974 | Sherman | 53/376.5 |
| 3,872,650 | 3/1975 | Vickers | 53/207 |
| 4,610,125 | 9/1986 | Meives | 53/207 |

*Primary Examiner*—Bruce M. Kisliuk
*Assistant Examiner*—Jack Lavinder
*Attorney, Agent, or Firm*—Allen D. Gutchess, Jr.

[57] ABSTRACT

A die cut and scored carton blank is formed into a carton. The carton blank is placed in a trough having a side wall and at least one retractable stop for turning upwardly elongate edge flaps of the carton blank, with the trough having two end walls for turning up end flaps of the carton blank. The partially-formed carton is then moved to a second position where it is lowered and horizontal glue strips are applied to an outer surface of an elongate edge flap. As the carton is moved toward the second position, glue strips are applied to end flaps of the carton blank. The partially-formed carton is then moved to an upper position, above the level of the trough, and into a compression chamber where side walls and end walls hold the flaps together until the glue hardens.

19 Claims, 3 Drawing Sheets

METHOD AND APPARATUS FOR FORMING CARTONS

This invention relates to a method and apparatus for forming cartons from cut and scored cardboard blanks.

The apparatus includes a table having a waist-high forming trough. The trough has a bottom wall, a longitudinal side wall, two end stops, and two retractable stops spaced from the side wall. The die cut and scored cardboard blank has a first elongate edge flap, a bottom panel, a second elongate edge flap, a top panel, and a third elongate edge flap. The bottom and top panels have first and second end flaps, respectively, and the first and second elongate edge flaps also preferably have third and fourth end end flaps.

The operator places the bottom panel of the blank on the bottom wall of the trough. The side wall of the trough turns the first elongate edge flap upwardly, and the retractable stops move the second elongate edge flap upwardly, with assistance from the operator. The end stops move the first end flaps upwardly with the third and fourth end flaps being tucked inside by the operator. The contents are then placed on the bottom panel of the carton.

The retractable stops are then retracted and a fluid-operated ram moves the partially-formed carton and the contents away from the trough toward the back of the table and onto an elevator platform. During this movement, an upper stop lowers the top panel and the third elongate edge flap as the partially-formed carton moves. Also, at least one glue gun is located at each end of the table to apply at least one glue strip to the outer surfaces of the first end flaps.

The elevator platform is then lowered to lower the partially-formed carton to a position below the level of the trough. End stops on the elevator platform maintain the first end flaps in their upper position. A rear side wall holds the second elongate edge flap in position and an intermediate side wall with elongate openings maintains the first elongate edge flap in position. Traveling glue guns then apply horizontal strips of glue to the outer surface of the first elongate edge flap.

The elevator platform then moves the partially-formed carton to an upper position which is above the lower position and above the level of the trough. A compression chamber is located at the upper position which is formed by rear and front walls and end walls. As the partially-formed carton is moved into the chamber, the top panel is lowered completely to a horizontal position and the third elongate edge flap is moved downwardly into contact with the outer surface of the first elongate edge flap and held against it until the glue hardens. During the upward movement, the second end flaps are moved downwardly into contact with the outer surfaces of the first end flaps and held in position by the end walls of the compression chamber until the glue hardens at these areas. The walls of the compression chamber are preferably made of metal to conduct heat more effectively and hasten the hardening of the glue. Spring-loaded tabs in the front and rear walls of the compression chamber help hold the now newly-formed carton in place.

In a preferred form, the retractable stops of the trough can be adjusted inwardly and outwardly, as well as a side wall and an end wall of the compression chamber.

The cartons with which the invention is concerned are long and unwieldy, typically being used to contain a number of pieces of house siding, commonly sold in twelve-foot lengths.

It is, therefore, a principal object of the invention to provide an improved method and apparatus for forming cartons, particularly large and unwieldy ones.

Many other objects and advantages of the invention will be apparent from the following detailed description of a preferred embodiment thereof, reference being made to the accompanying drawings, in which.

Figure 7:
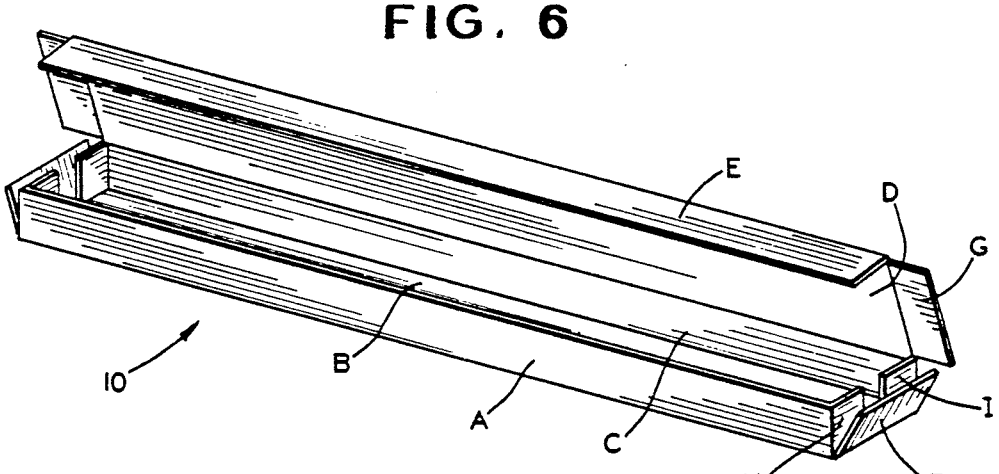
FIG. 7 is a view in perspective of a die cut and scored carton blank of sheet material which is used with the apparatus of FIGS. 1–6.

Referring first to FIG. 7, a die cut and scored blank from which a carton is formed is indicated at 10 and is made of suitable sheet material, such as corrugated board. The blank 10 has a first or inner front elongate flap designated A which is connected along an edge to an edge of a bottom panel B which forms the bottom of the carton. A second or rear elongate edge flap C is connected to the other longitudinal edge of the bottom panel B and in turn connects to a longitudinal edge of a top panel D, which forms the top of the carton. A third or outer front elongate edge flap E is connected to the longitudinal edge of the top panel D opposite the elongate flap C. The bottom panel B has a first end flap F at each end and the top panel D has a second end flap G at each end. Preferably, the elongate edge flaps A and C also have third and fourth end flaps H and I at each end, respectively. When the carton is used to contain vinyl house siding, by way of example, the finished carton is twelve feet long, twelve inches wide, and six inches high, by way of illustration. Such a carton can contain twenty-two pieces of siding, which are first placed in an internesting relationship by an operator.

Figure 1:
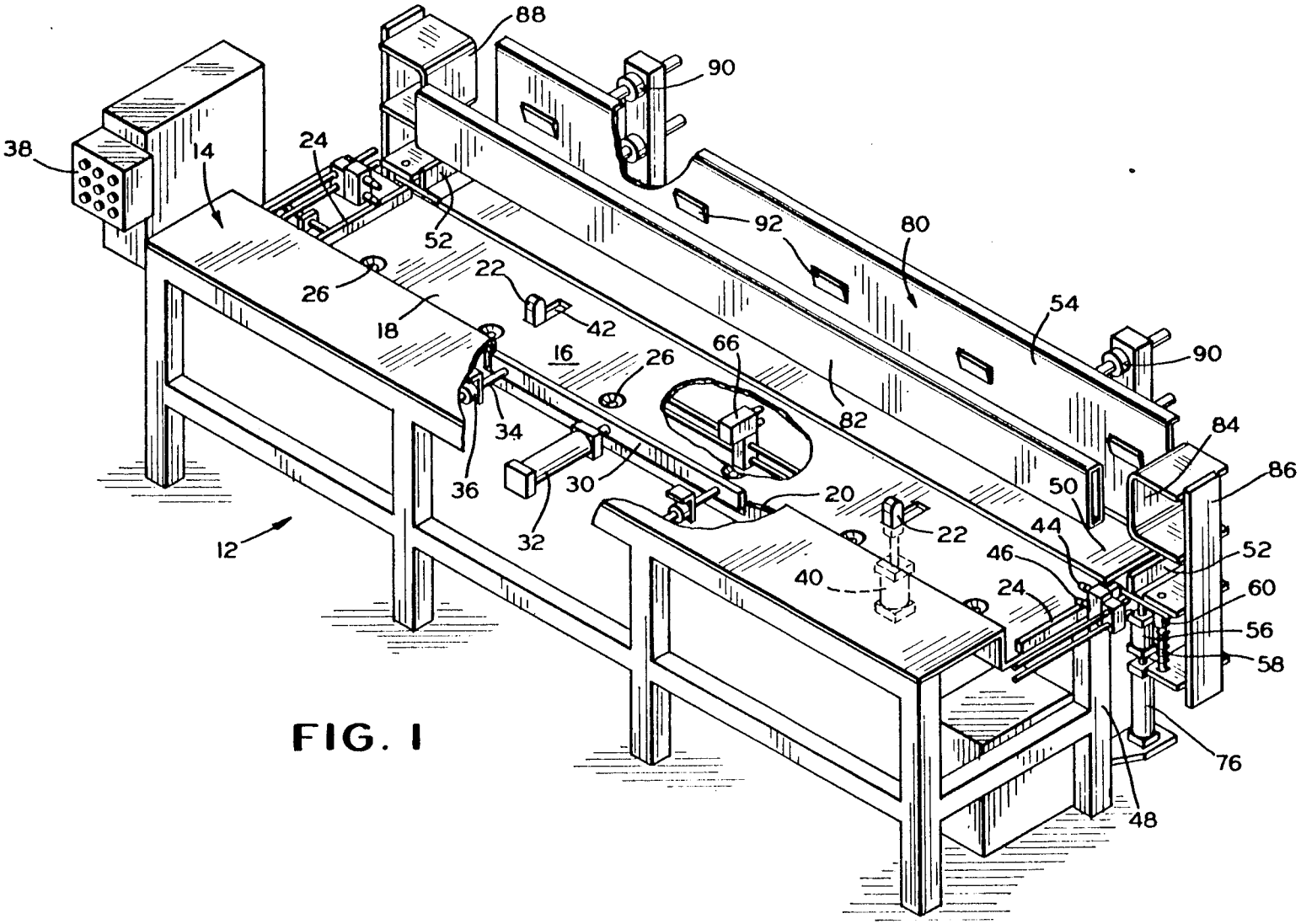
FIG. 1 is a somewhat schematic view in prespective of carton-forming apparatus in accordance with the invention, with parts broken away.
Figure 2:
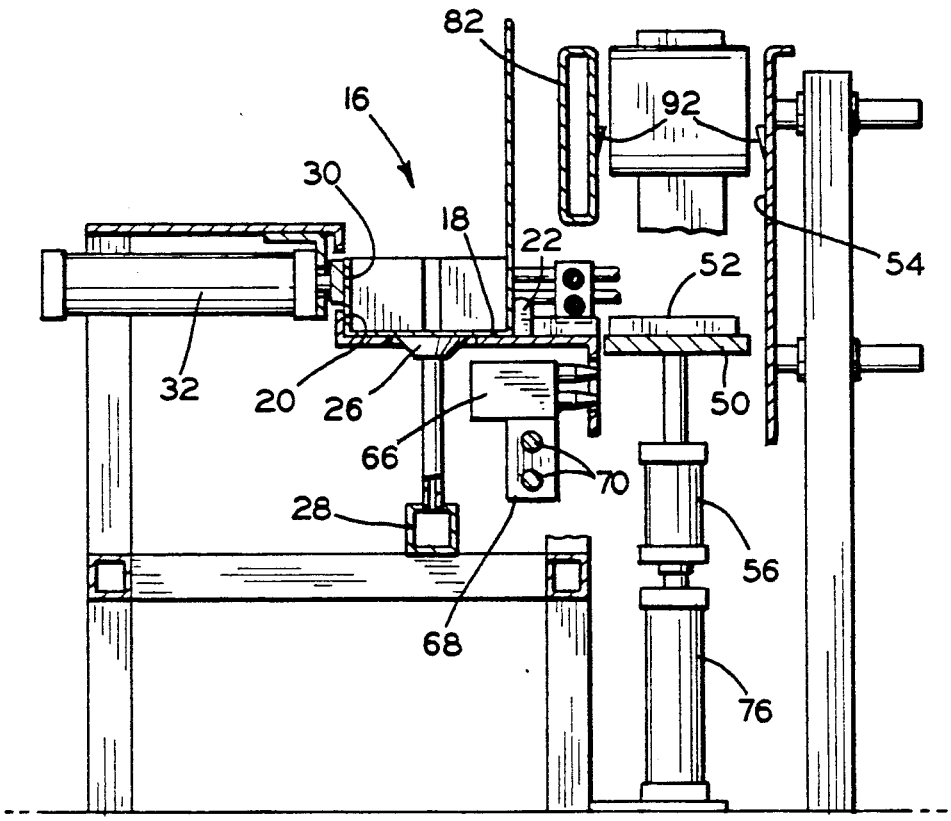
FIG. 2 is a somewhat schematic view in transverse cross section of the apparatus of FIG. 1, with a partially-formed carton in a first position.

Referring particularly to FIGS. 1 and 2, carton-forming apparatus in accordance with the invention is indicated at 12 and includes a waist-high table 14. Toward the front of the table is a forming trough 16 which is formed in part by a bottom wall 18, a front side wall 20, and retractable stops 22. The trough 16 further includes upright end walls 24 at the ends, one of which is adjustable toward and away from the other. Several vacuum cups 26 can be located along the bottom wall 18 and are connected to a vacuum manifold 28 (FIG. 2). The cups are used to assist in pulling the bottom panel B of the blank 10 down against the bottom wall 18 of the trough when the blank 10 is placed in the position shown in FIG. 2. At this time, the elongate front flap A is turned upwardly by the front wall 20 as the bottom panel is pushed downwardly. The rear elongate flap C is also turned upwardly by the retractable stops 22. The end flaps F are also turned upwardly by the end walls 24 of the trough 16. At this time, the short end flaps H and I, if used, are tucked inside the end flaps F with the aid of the operator, leaving the outer surfaces of the end flaps F exposed.

The partially-formed carton as shown in FIG. 2 is then loaded with the contents. If vinyl siding is being packaged, the individual slats can be first prenested by the operator or another operator. The loaded, partially-formed carton is then moved from the first position of FIG. 2 to a second position of FIG. 3. This can be accomplished by a pusher bar 30 which can form part of the front side wall 20 of the trough 16. The bar 30 can be moved by a fluid-operated ram 32 and guided by guide rods 34 (FIG. 1) which slide through bearing blocks 36.

The operation of the fluid-operated ram 32 as well as other components of the apparatus 12 can be controlled by the operator through a suitable control panel 38. At this time, the retractable stops 22 are retracted below the trough 16 by suitable fluid-operated rams 40. The stops 22 can be adjustably moved in the slots 42 by suitable screw jack mechanism or the like (not shown) to vary the width of the trough 16, as represented by the distance between the front wall 20 and the stops 22. Stationary glue guns 44 and 46 are mounted on a post 48 at each end of the trough 16 near the rear longitudinal edge thereof. As the partially-formed carton is moved toward the second position of FIG. 3, glue is supplied through the guns 44 and 46 to apply two strips of glue on the outer surfaces of the end flaps F.

Figure 3:
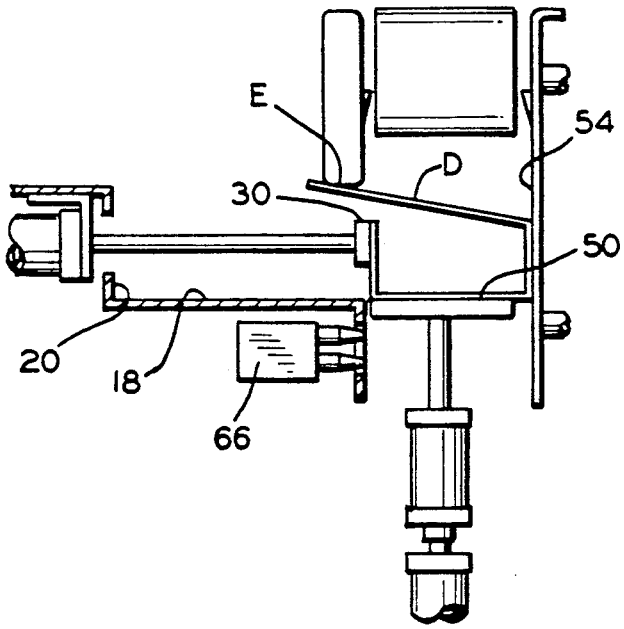
FIG. 3 is a schematic view in transverse cross section of part of the apparatus of FIG. 2, showing a partially-formed carton in a second position.

In the second position of FIG. 3, the partially-formed, loaded carton is located on an elevator platform 50 and the top panel D along with the outer front elongate flap E are moved toward a partially closed position. The elevator platform 50 has traveling side stops 52 which hold the end flaps F, now with the glue strips, in their upright positions. The edge flap C is maintained upright by a large back panel 54 at the rear of the apparatus 12. The elevator platform 50 is moved vertically by fluid-operated rams 56 at end portions thereof and guided by guide rods 58 received in bearings 60 (FIG. 1).

Figure 4:
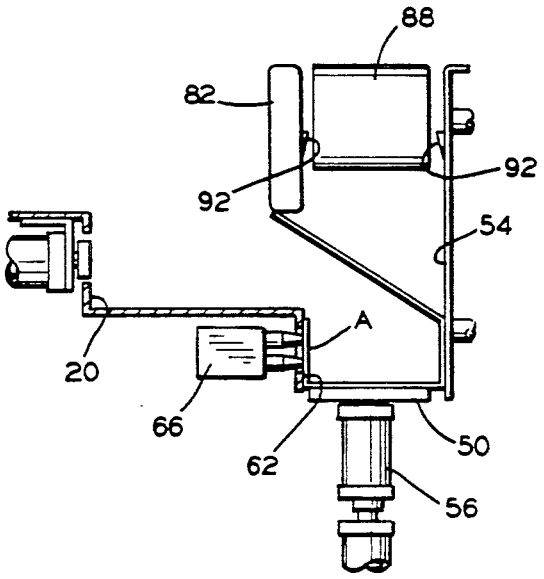
FIG. 4 is a schematic view similar to FIG. 3, showing a partially-formed carton in a third position.
Figure 6:
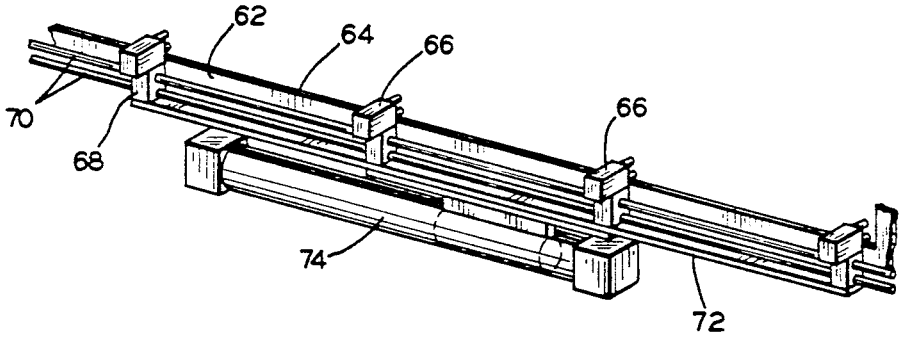
FIG. 6 is a somewhat schematic view in perspective of glue-applying apparatus embodied in the apparatus of FIG. 1.

With the partially-formed and loaded carton in place on the platform 50, the platform 50 is first lowered to a third position as shown in FIG. 4. In this position, the elongate flont flap A is held upright by an intermediate wall 62 having at least one elongate opening 64 (FIG. 6) therein. Additional means, such as pins, can be used at intermediate portions of the front flap to keep it upright. Traveling glue guns 66 are mounted on blocks 68 which are slidably received on guide rods 70 with the blocks 68 being connected by a bar 72. The bar 72 is reciprocated by a commercially-available rodless cylinder or fluid-operated ram 74 to move the glue guns 66 back and forth longitudinally of the opening 64 to apply glue strips to the front surface of the panel A.

Figure 5:
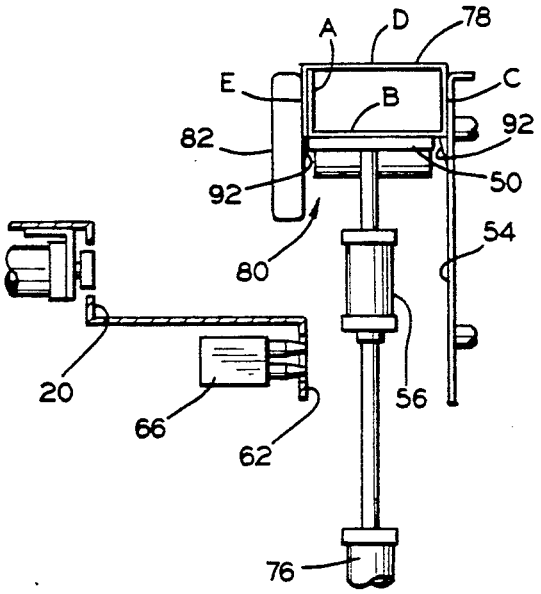
FIG. 5 is a schematic view similar to FIG. 3, showing a carton in a fourth position.

After the glue has been applied, the elevator platform 50 is raised to bring the partially-formed carton to a fourth position, as shown in FIG. 5. The upward movement of the platform 50 is accomplished by larger fluid-operated rams 76 which are in tandem with the rams 56. In the fourth position, the now fully-formed carton, indicated at 78, is in a "compression" chamber 80. The chamber 80 is formed by the back wall 54, a shorter elongate front wall 82, an end wall 84 mounted on a post 86, and an end wall 88 which can be adjustably held by screw jacks or the like (not shown). The back wall 54 also can be adjustably mounted by screw jacks 90 for movement toward and away from the front wall 82. A plurality of spring-loaded tabs 92 are mounted on the walls 54 and 82. These serve to apply additional pressure to the outer front flap E to aid in sealing the carton and also hold the newly-formed carton 78 in the upper position of FIG. 5. In this position, the carton can be removed or pushed further upwardly by the next newly-formed carton, where it can subsequently be removed.

During the movement of the carton from the third position of FIG. 4 to the fourth position of FIG. 5, the top panel D is pushed downwardly further and the outer front flap E is moved downwardly against the outer surface of the inner front flap A where it is held in position in the compression chamber until the glue hardens. Also the end flaps G are moved downwardly and into contact with the inner end flaps F, being held by the compression chamber end walls 84 and 88 until the glue hardens. The walls making up the compression chamber 80 are of metal and serve to conduct heat away from the carton to hasten the hardening of the glue.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. Apparatus for aiding in the formation of a carton, said apparatus comprising means forming a trough having a bottom, a side wall, at least one retractable stop spaced from said side wall, and two end walls, means for moving a partially-formed carton away from said trough beyond said retractable stop when said stop is retracted, means for applying glue to end flaps of the partially-formed carton as said carton is moved by said moving means, means for lowering the partially-formed carton to a lower position below said bottom and for raising the partially-formed carton to an upper position above said bottom, means for applying glue to an elongate edge flap of the partially-formed carton when in the lower position, and wall means above said bottom wall for holding edge and end flaps together when the carton is in the upper position.

2. Apparatus according to claim 1 wherein traveling side stops are mounted on said lowering and raising means to hold the end flaps in an upright position.

3. Apparatus according to claim 1 wherein said wall means have spring-loaded tabs for engaging portions of said carton when the carton is moved toward the upper position.

4. Apparatus according to claim 1 wherein said wall means comprises elongate side walls and end walls, and means for adjusting at least one of said elongate side walls toward and away from the other.

5. Apparatus according to claim 1 wherein suction cups communicate with said trough bottom for engaging a portion of a carton when in said trough.

6. Apparatus according to claim 1 wherein one of said end walls is adjustable toward and away from the other.

7. Apparatus according to claim 1 wherein said lowering and raising means comprises two fluid-operated rams mounted in tandem.

8. Apparatus according to claim 1 wherein a portion of said wall means is positioned to lower an upper panel of the carton as the partially-formed carton is moved away from said trough beyond said retractable stop.

9. A method of forming a carton from a blank having a first elongate edge flap, a bottom panel, a second elongate edge flap, a top panel, and a third elongate edge flap, with the bottom panel having first end flaps and the top panel having second end flaps, said method comprising placing the bottom panel in a trough and folding upwardly said first and second elongate edge flaps and said first end flaps, moving said partially-formed blank in a horizontal direction away from said trough, applying at least one glue strip to outer surfaces of said first end flaps, and moving said top panel downwardly toward a horizontal position parallel to said bottom panel, applying at least one glue strip to an outer surface of said first elongate edge flap, moving said partially-formed blank to an upper position above the level of said trough, simultaneously moving said third elongate edge flap downwardly and into contact with the outer surface of said first elongate edge flap, and simultaneously moving said second end flaps downwardly and into contact with the outer surface of said first end flaps, and holding said flaps in contact until the glue hardens.

10. The method according to claim 9 further comprising moving said partially-formed blank to a lower position below the level of said trough before applying glue to the outer surface of said first elongate edge flap.

11. The method according to claim 9 further comprising applying the glue strip to the outer surfaces of said first end flaps as said partially-formed blank is moved in the horizontal direction away from said trough.

12. Apparatus for aiding in the formation of a carton from a die cut and scored blank having a first elongate edge flap, a bottom panel, a second elongate edge flap, a top panel connected by said second elongate edge flap, and a third elongate edge flap, said first elongate edge flap being connected to an edge of said bottom panel, said third elongate edge flap being connected to an edge of said top panel, first end flaps connected to ends of said bottom panel, and second end flaps connected to ends of said top panel, said apparatus comprising a trough having a bottom for receiving the bottom panel and means for turning upwardly said first elongate edge flap, said second elongate edge flap, and said first end flaps, at least one retractable stop in said trough, means for moving a partially-formed carton away from said trough beyond said retractable stop when said stop is retracted, first means for applying glue to outer surfaces of said first end flaps, second means for applying glue to an outer surface of said first elongate edge flap, and wall means for turning said third elongate edge flap into contact with said first edge flap, for turning said second end flaps into contact with said first end flaps, and for holding said flaps together until the glue hardens.

13. Apparatus according to claim 12 wherein suction cups are located in the trough bottom to aid in holding the bottom panel against the trough bottom.

14. Apparatus according to claim 12 wherein said second glue-applying means is below the level of said trough bottom.

15. Apparatus according to claim 12 wherein said wall means is positioned above said second glue-applying means.

16. Apparatus according to claim 15 wherein at least some of said wall means have spring-loaded tabs for engaging portions of said carton to aid in holding at least some flaps together.

17. Apparatus according to claim 12 wherein said first means for applying glue is positioned to apply the glue to said first end flaps as the partially-formed carton is moved by said moving means.

18. Apparatus according to claim 12 wherein raising and lowering means moves a partially-formed carton to a lower position adjacent said second glue-applying means and to an upper position into engagement with said wall means.

19. Apparatus according to claim 18 wherein said raising and lowering means comprises two fluid-operated rams mounted in tandem.

* * * * *